US006402894B1

(12) United States Patent
Lamas et al.

(10) Patent No.: US 6,402,894 B1
(45) Date of Patent: Jun. 11, 2002

(54) SEALING ARRANGEMENT FOR PULP DEWATERING ARRANGEMENT

(75) Inventors: Axel Lamas; Goran Brottgardh; Johan Eriksson, all of Karlstad (SE)

(73) Assignee: Kvaarner Pulping AB (SE)

( * ) Notice: Subject to any disclaimer, the term of this patent is extended or adjusted under 35 U.S.C. 154(b) by 0 days.

(21) Appl. No.: 09/635,979

(22) Filed: Aug. 9, 2000

(30) Foreign Application Priority Data

Aug. 27, 1999 (SE) ..... 9903078

(51) Int. Cl.[7] ..... D21F 1/04; D21F 1/60

(52) U.S. Cl. ..... 162/323; 162/328; 162/331; 162/357; 100/121; 100/99; 100/118; 100/120; 100/156; 210/326; 210/386

(58) Field of Search ..... 162/323, 328, 162/331, 357; 100/121, 99, 118, 120, 156; 210/326, 386; 68/181 R

(56) References Cited

U.S. PATENT DOCUMENTS 2,396,694 A * 3/1946 Goodwillie et al. ..... 92/43

4,543,161 A * 9/1985 Fujimoto ..... 162/323

* cited by examiner

*Primary Examiner*—Peter Chin
*Assistant Examiner*—Mark Halpern
(74) *Attorney, Agent, or Firm*—Fasth Law Offices; Rolf Fasth

(57) ABSTRACT

Arrangement 1 for washing and dewatering a fiber pulp suspension, which arrangement comprises two hollow, circular-cylindrical screen members 2*a*, 2*b* delimited by envelope surface and end walls. The screen members rotate towards each other to form a nip 10, at least one of the said screen members 2*a*, 2*b* being arranged in a vat 6 which partially encloses the envelope of the screen member and which, in the direction of rotation of the screen member, converges towards the envelope of the screen member. The invention relates to a sealing arrangement 8 at the end wall of the screen member. By retracting the seal a distance X from the envelope surface of the screen member in a limited area α near the nip 10, the seal is relieved of the very high hydraulic and mechanical pressures which occur in the nip. Wear between the end wall of the drum and the seal at the press nip is reduced. A simple pressurized seal can thus be used with the same low pressure applied along the entire circumference.

16 Claims, 3 Drawing Sheets

B–B

A–A

SEALING ARRANGEMENT FOR PULP DEWATERING ARRANGEMENT

TECHNICAL FIELD

The present invention relates to a sealing arrangement.

BACKGROUND AND SUMMARY OF THE INVENTION

When producing paper pulp from cellulose-containing fibre material, it is necessary to wash and dewater the paper pulp at a number of stages in the process.

A previously known and commonly used arrangement for washing and dewatering paper pulp, called a wash press, is disclosed in SE-C-380,300, SE-C-501,710, U.S. Pat. No. 5,488,900 and SE-C-504,011. The arrangements disclosed in these documents comprise two cylindrical, rotatable screen members arranged in an essentially converging vat. Other examples of known arrangements are disclosed in U.S. Pat. No. 4,543,161 and in U.S. Pat. No. 5,667,642, the latter constituting an arrangement in which the screen members rotate in the opposite direction to the conventional one, that is to say, as seen from the short end, the right-hand screen member rotates counter-clockwise and the left one rotates clockwise.

A problem encountered in washing and dewatering with wash presses of the above mentioned type is that a very high local pressure is built up at the end of the screen drum, which acts on the sealing arrangement at the end wall. U.S. Pat. No. 4,543,161 discloses two alternatives for handling the high pressures in the nip. In a first variant, shown in FIGS. 3–4, the ends of the drums are given a slightly smaller dimension, for which reason the pulp dewatered in the nip can be pressed out into a collection shaft which is formed in the area of reduced diameter of the drum. In this way, the high pressure at the end wall of the screen drum is reduced.

A second variant, shown in FIGS. 5–7, is a variant with low-friction shields which bear against the end walls of the drum in the area of the nip and prevent the pulp from being pressed out to the sides in the nip. This type of seal becomes greatly worn because the very high local hydraulic and mechanical pressures against the ends of the drum in the smallest cross section of the nip are maintained. These solutions reveal two extremes of the sealing problems, one solution resulting in a lower dry substance content of the wash press, and the other solution still resulting in very high pressures at the end wall of the screen drum.

An object of the present invention is to permit an improved sealing of the end walls of the wash press by means of controlled pressure relief at the end walls of the screen drum.

A further object is to make available a wash press with improved sealing of the end walls, which sealing allows fibre residues, which may be pressed into the pressure relief zone, to be continuously returned to the level of the envelope surface downstream of the nip. In this way, it is possible to avoid successive build-up of an increasingly hard dewatered fibre plug. The wash press can in this way be operated for longer periods of time without unnecessary shutdown for cleaning, or without the need for complicated cleaning arrangements.

Yet another object is to make available a wash press with improved sealing of the end walls, which sealing consists of a sealing profile, preferably with a pressurized seal, which affords a cost-effective sealing construction.

Yet another object of a preferred embodiment with pressurized sealing is that the pressure can be kept at a constant level in the whole sealing strip, while at the same time achieving an optimum sealing capacity around the entire circumference of the end wall. The pressure relief in the area of the nip means that one and the same pressure can be applied in the seal and still be sufficient in the area of the nip where the press forces on the pulp web are extremely high. At the same time, a contiguous sealing element can be used with just one pressurizing chamber. The seal does not therefore need to be divided into parts, pressurized at different levels, and this reduces the costs of the seal and of the pressurizing system for the sealing strip.

BRIEF DESCRIPTION OF THE FIGURES

The invention will be described below with reference to the figures, of which.

DETAILED DESCRIPTION

Figure 1:
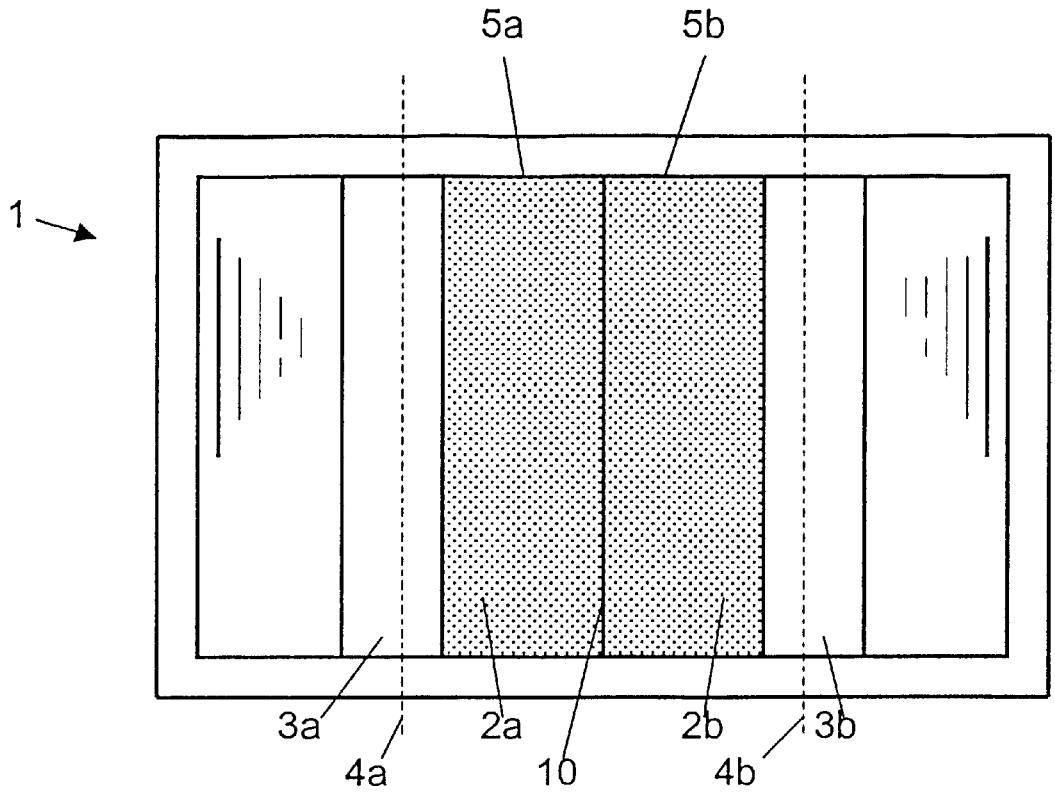
FIG. 1 is a diagrammatic view of a wash press.
Figure 2:
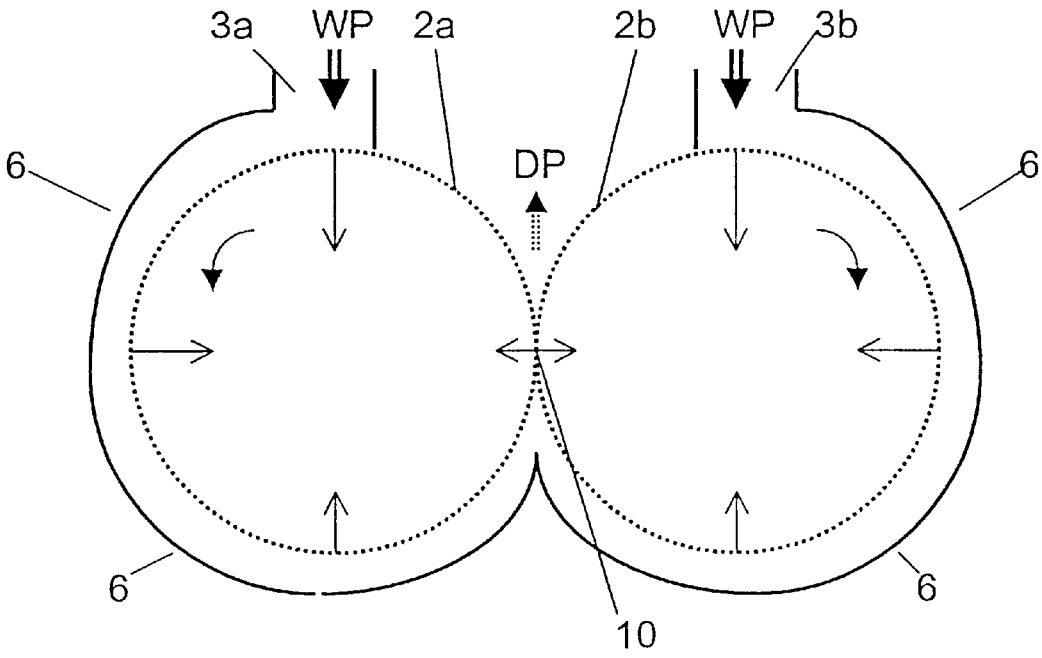
FIG. 2 shows a cross section of the wash press, :as seen from below in FIG. 1.

The type of wash press in which the sealing arrangement according to the invention is used is shown in FIGS. 1 and 2 and comprises two hollow, circular-cylindrical screen members 2*a*, 2*b* which include a number of evacuation chambers (not shown) under the envelope surface of the screen member for the purpose of leading off evacuated liquid.

The pulp suspension WP is fed into the inlet boxes 3*a* and 3*b* and transported, under rotation of the screen members 2*a*, 2*b*, into a converging gap between a vat 6 and the surface of the screen members 2*a*, 2*b*, and onwards to a nip 10 between the screen members. The dewatered pulp DP is then withdrawn upwards after it has passed the nip 10.

The two screen members form a press nip 10 between each other and are arranged to rotate towards each other, so that, as seen from the short end (FIG. 2), the right-hand screen member rotates clockwise and the left-hand screen member rotates counter-clockwise.

The wash press 1 preferably has a diameter of 1.0–2.5 meters. Its envelope 3 is also perforated in order to allow liquid to be evacuated from a web of fibre pulp lying against the envelope surface.

In the preferred embodiment shown in FIGS. 1 and 2, a pulp inlet box 3*a*, 3*b* is arranged on each drum 2*a*, 2*b*, respectively. Each pulp inlet box 3*a*, 3*b* is arranged at 0° on the wash press, where 0° represents the highest/uppermost point of the wash press and the degrees increase positively in the direction of rotation of the screen member. Incoming paper pulp, which normally has a concentration of about 1–12%, preferably 3–10%, is distributed uniformly across the length of the screen member by means of the inlet box.

The screen members are arranged to rotate at a speed of 5–20 rpm by means of a suitable drive device. Paper pulp thus follows the rotation of the screen members in the gap between the perforated envelope surface 2*a*, 2*b* and the walls of the vat 6, where it forms a web of fibre pulp which is dewatered by virtue of the fact that the gap converges in the direction towards the nip. The liquid which is pressed out from the web of fibre pulp is led off (not shown) from the arrangement. At wash zones, where the gap can diverge slightly, wash liquid can be introduced into the web of fibre pulp, and the latter is washed.

Finally, the web of fibre pulp is dewatered, by means of the pressure in the nip 10, to a concentration which is about 5–20 times higher than the concentration of the incoming paper pulp, for example 1–12% on admission and 25–40% downstream of the nip. The web of fibre pulp is torn off from the envelope 2*a*, 2*b* and led off from the arrangement by means of suitable shredders/conveyor screws.

Figure 3:
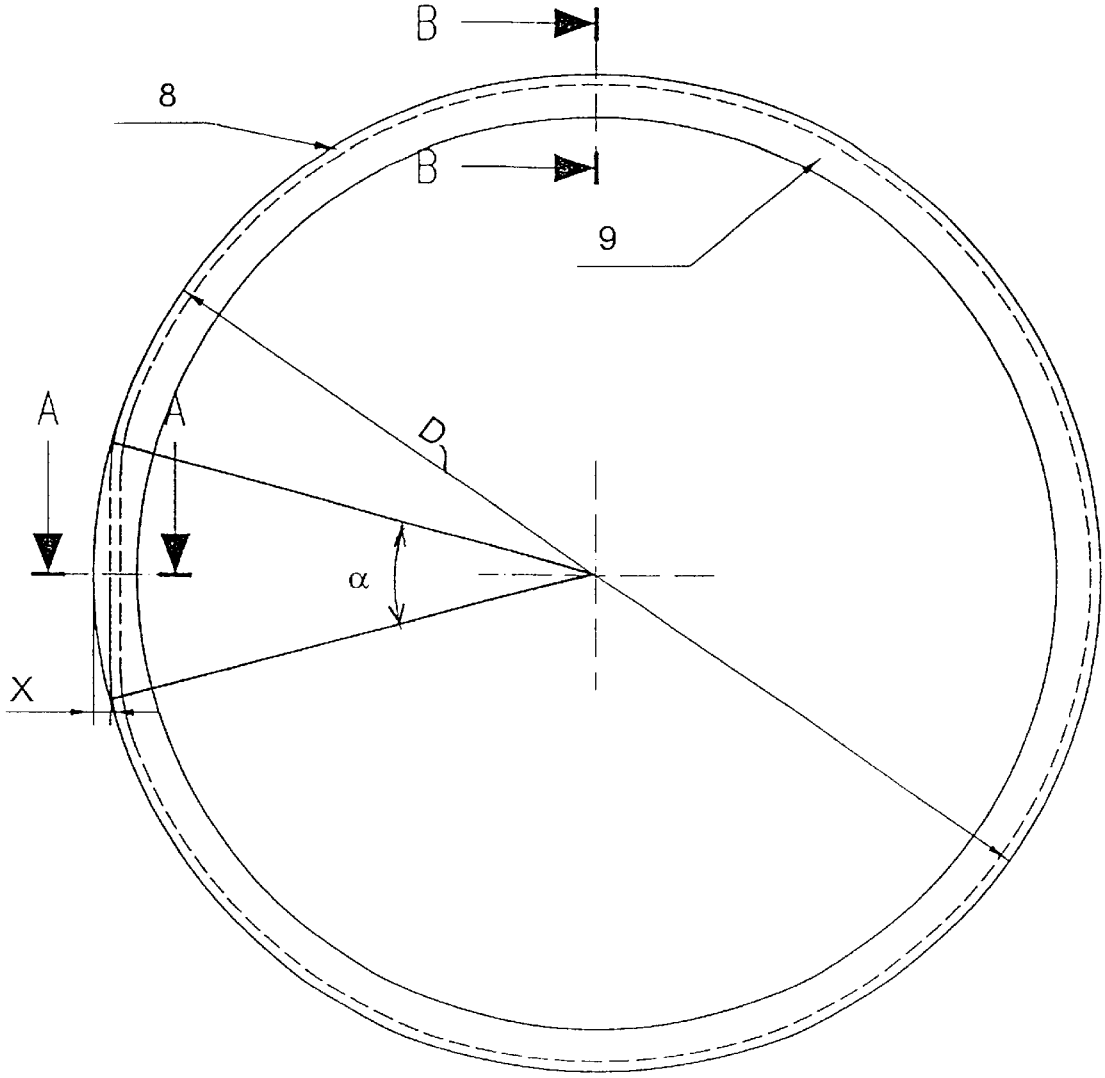
FIG. 3 shows an overview of a sealing arrangement according to the invention, arranged on an end wall of a drum in a wash press.

According to the invention as shown in FIG. 3, a sealing arrangement comprises a seal 8 which seals between the end wall 5*a*, 5*b* of the screen member and a housing 13 surrounding the screen member, in the area of the end wall 5*a*, 5*b*. The seal 8 is arranged at a first distance from the circumferential plane of a screen member along at least a predetermined part of the periphery of the screen member, but excluding the area at the nip 10, and the sealing element is arranged at a second distance X from the circumferential plane of the screen member near the nip 10, the second distance being greater than the first distance. The distance X from the plane of the envelope surface in the area of the nip corresponds to a measurement in the range of 10–1000 millimeters, preferably 20–60 millimeters, more preferably 25 millimeters.

This retracted position of the seal from the plane of the envelope surface results in a pressure relief in the nip in the vicinity of the seal, which greatly reduces the load on the seal.

The first distance at which the seal is arranged from the plane of the envelope surface corresponds essentially to a 0 distance, meaning that the sealing arrangement touches the plane of the envelope surface. In this way, it is possible to achieve complete sealing against those areas of the pulp web where the pressures are not as high as in the press nip 10. This prevents fibre becoming packed in the gap between the end wall of the drum and the seal. holder. The gap is necessary for manufacturing tolerances and heat expansion.

The sealing arrangement is retracted towards the center of rotation of the screen member, in the area of the nip, across an angle range in the range of 15–60 degrees, preferably 25–50 degrees, more preferably 25–35 degrees. In the preferred embodiment, the seal thus lies in such a way that it touches the plane of the envelope surface over the remaining parts of the turn. The first distance for the seal, resulting in the seal touching the plane of the envelope surface, is formed over an angle in the range of 300–345 degrees, preferably 310–335 degrees, more preferably 325–335 degrees.

To achieve a good transition between the retracted position of the seal and the position in which it touches the plane of the envelope surface, it is advantageous for the seal to converge seamlessly to the first distance in the angle range by which the seal is retracted relative to the envelope surface of the screen member. This provides a symmetrical retraction of the seal 8 around the press nip 10, i.e. identical upstream and downstream of the press nip 10.

Figure 4:
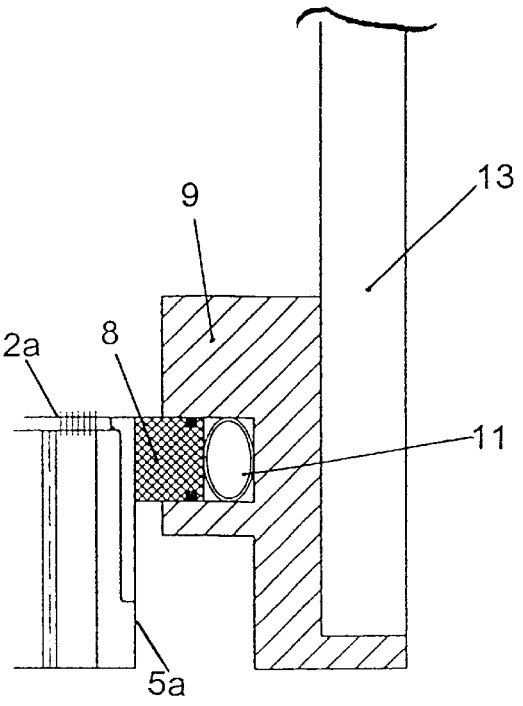
FIG. 4 shows the sealing arrangement according to the invention, seen in cross section B—B from FIG. 3.
Figure 5:
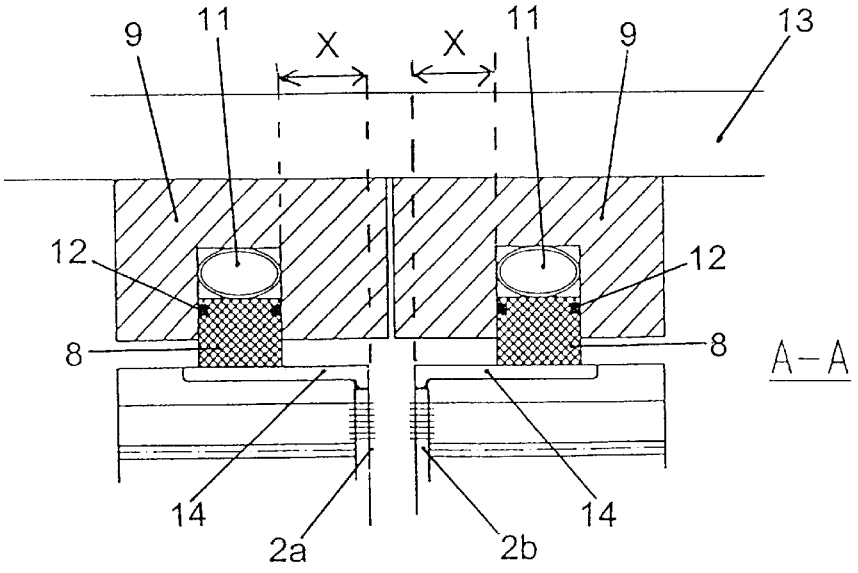
FIG. 5 shows the sealing arrangement according to the invention, as seen in cross section A—A from FIG. 3.

The preferred seal is a pressurized seal corresponding to that shown in FIGS. 4 and 5. The seal comprises a pressurizing chamber arranged in the housing 13, which pressurizing chamber acts on the sealing surfaces. 8 of the seal against the end walls 5*a*, 5*b* of the drum. Exchangeable wear rings 14 are preferably arranged on the end walls.

The seal also preferably consists of a sealing element 8 which is contiguous in the circumferential direction, with identical sealing profile, which sealing element is arranged in a groove in a seal holder 9 arranged on the housing 13. The seal 8 can in turn be provided with sealing rings 12 which prevent impurities from penetrating into the pressure chamber and, if appropriate, permit pressurizing directly in the groove for the seal 8. The pressurizing chamber 11 of the seal preferably consists of a pressurizing chamber 11 which is contiguous in the circumferential direction, which pressurizing chamber 11 is arranged in the bottom of the groove in the seal holder 9.

The division of pressure chamber and seal part is not absolutely necessary, and the pressurizing chamber 11 may preferably be made integral with the sealing part of the seal 8 in the same way as with "CEFILAIR®" pneumatic seals.

The arrangement according to the invention is not limited to the embodiments described above, and instead it can be varied within the scope of the attached patent, claims. For example, the seal can be retracted asymmetrically around the press nip 10. It can be retracted starting immediately in front of the press nip and it can more quickly reach the maximum retracted distance, which distance is maintained for a length after the press nip.

The so-called "0 distance" between the seal and the plane of the envelope surface, excluding the area around the press nip 10, can of course be given a minimum drawing-in corresponding to a fraction of the drawing-in at the press nip 10. The essential feature of the inventive concept is that pressure relief in the press nip is permitted by the fact that the pressure can be temporarily led off across the end surface of the drum.

Alternatively, a local drain or pressure outlet can be arranged upstream or downstream of the press nip, radially outwards from the retracted seal. An extra drain in the holder 9 can facilitate evacuation of liquid which is pressed out at the press nip. An outlet for compressed air directly downstream of the press nip can prevent the build-up of fibre plugs.

A number of wash zones, where liquid is also added to remove the liquid in the fibre web, can be introduced between the inlet boxes and the press nip 10. In certain applications, the wash zones can also be completely omitted,, in which case only pressing of the pulp web is carried out.

While the present invention has been described in accordance with preferred compositions and embodiments, it is to be understood that certain substitutions and alterations may be made thereto without departing from the spirit and scope of the following claims.

We claim:

1. An arrangement for washing and dewatering a fiber pulp suspension, comprising:

a first and a second circular-cylindrical screen member, each screen member having an envelope surface and end walls, the screen members being rotatably towards one another to form a nip therebetween, the first screen member being hollow to permit evacuation of a liquid radially inwardly into the first screen member, the first screen member being arranged in a vat that partially encloses the envelope surface of the first screen member, the vat converging towards the envelope surface of the first screen member in a rotational direction of the first screen member;

a first pulp inlet box being arranged adjacent to the first screen member for introducing a fiber pulp between the envelope surface of the first screen member and the vat to form a web of the fiber pulp on the first screen member;

a means for introducing a wash liquid between the inlet box and the nip; a means of withdrawing dewatered pul after the nip; and a sealing arrangement having a seal for sealing between the end walls of the first and second screen members and a housing surrounding the first and second screen members, the seal being arranged a first distance from circumferential planes of the envelope surfaces and along a predetermined portion of a periphery of the envelope surfaces of the first and second screen members, the seal being arranged a second distance from the circumferential plane of the envelope surfaces adjacent to the nip, the second distance being greater than the first distance.

2. The arrangement according to claim 1 wherein the second distance is between about 10–1000 millimeters.

3. The arrangement according to claim 1 wherein the second distance is between about 20–60 millimeters.

4. The arrangement according to claim 1 wherein the second distance is about 25 millimeters.

5. The arrangement according to claim 1 wherein the sealing arrangement is in contact with the circumferential planes of the envelope surfaces of the first and second screen members.

6. The arrangement according to claim 1 wherein the sealing arrangement has a retracted segment that is retracted towards a center of rotation of the first and second screen members adjacent to the nip, the retracted segment spanning over a peripheral angle range of between 15–60 degrees of the circumferential planes of the envelope surfaces.

7. The arrangement according to claim 6 wherein the peripheral angle range is between 25–50 degrees.

8. The arrangement according to claim 6 wherein the peripheral angle range is between 25–35 degrees.

9. The arrangement according to claim 1 wherein the seal touches a peripheral angle range of between 300–345 degrees of the circumferential planes of the envelope surfaces.

10. The arrangement according to claim 9 wherein the peripheral angle range is between 310–335 degrees.

11. The arrangement according to claim 9 wherein the peripheral angle range is between 325–335 degrees.

12. The arrangement according to claim 6 wherein the seal continuously converges from the second distance to the first distance in the retracted segment.

13. The arrangement according to claim 1 wherein the housing has a pressurizing chamber defined therein and the chamber is in operative engagement with the seal and the end walls has replaceable wear rings.

14. The arrangement according to claim 13 wherein the housing has a seal holder, the seal holder has a groove defined therein for holding the seal therein.

15. The arrangement according to claim 14 wherein the pressurizing chamber is in operative engagement with the groove.

16. The arrangement according to claim 15 wherein the pressurizing chamber is integral with a sealing component of the seal.

* * * * *